US012049894B2

(12) United States Patent
Milner et al.

(10) Patent No.: US 12,049,894 B2
(45) Date of Patent: Jul. 30, 2024

(54) MULTI-STAGE PUMP APPARATUS INCLUDING SEALING MEMBER

(71) Applicant: Edwards Limited, Burgess Hill (GB)

(72) Inventors: Paul Milner, Burgess Hill (GB); David Roy Hayler, Burgess Hill (GB); Phillip North, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 71 days.

(21) Appl. No.: 17/771,311

(22) PCT Filed: Oct. 9, 2020

(86) PCT No.: PCT/GB2020/052512
§ 371 (c)(1),
(2) Date: Apr. 22, 2022

(87) PCT Pub. No.: WO2021/079088
PCT Pub. Date: Apr. 29, 2021

(65) Prior Publication Data

US 2022/0389930 A1 Dec. 8, 2022

(30) Foreign Application Priority Data

Oct. 23, 2019 (GB) ..... 1915358

(51) Int. Cl.
*F04C 27/00* (2006.01)
*F01C 1/12* (2006.01)
(Continued)

(52) U.S. Cl.
CPC ..... *F04C 27/008* (2013.01); *F04C 18/126* (2013.01); *F04C 23/001* (2013.01);
(Continued)

(58) Field of Classification Search
CPC .... F04C 27/008; F04C 18/126; F04C 23/001; F04C 29/12; F04C 25/02; F04C 27/00;
(Continued)

(56) References Cited

U.S. PATENT DOCUMENTS 6,572,351 B2 * 6/2003 Durand ..... F04C 18/086 418/9
9,279,426 B2 * 3/2016 Schofield ..... F04C 27/02
2003/0133817 A1 * 7/2003 Naito ..... F04C 23/001 418/9

FOREIGN PATENT DOCUMENTS

CN 103807176 A 5/2014
CN 108194353 A 6/2018
(Continued)

OTHER PUBLICATIONS

British Examination Report dated Mar. 13, 2020 and Search Report dated Mar. 12, 2020 for corresponding British Application No. GB1915358.4, 6 pages.
(Continued)

*Primary Examiner* — Dominick L Plakkoottam
*Assistant Examiner* — Paul W Thiede
(74) *Attorney, Agent, or Firm* — Theodore M. Magee; Westman, Champlin & Koeher, P.A.

(57) ABSTRACT

Aspects of the present invention relate to a stator component for a pump housing. The stator component has a plurality of fluid inlet channels for conveying fluid to respective pumping chambers. The fluid inlet channels each have an inlet port for conveying fluid into the pumping chamber. A plurality of fluid transfer channels are provided for conveying fluid to a respective one of the fluid inlet channels. The fluid transfer channels each have an inlet for receiving pumped fluid. The stator component is adapted to receive at least one sealing member for inhibiting the conveyance of fluid into an associated one of the pumping chambers.
(Continued)

Aspects of the present invention relate to a pump housing, a cover plate and a pump. Aspects of the present invention also relate to a method of converting a stator component.

16 Claims, 8 Drawing Sheets

(51) Int. Cl.

| | |
|---|---|
| ***F01C 19/00*** | (2006.01) |
| ***F04C 18/12*** | (2006.01) |
| ***F04C 23/00*** | (2006.01) |
| ***F04C 25/02*** | (2006.01) |
| ***F04C 29/12*** | (2006.01) |
| *F04C 18/08* | (2006.01) |
| *F04C 29/00* | (2006.01) |

(52) U.S. Cl.
CPC ..... *F04C 29/12* (2013.01); *F01C 1/126* (2013.01); *F01C 19/005* (2013.01); *F04C 18/08* (2013.01); *F04C 18/088* (2013.01); *F04C 23/00* (2013.01); *F04C 23/003* (2013.01); *F04C 25/02* (2013.01); *F04C 27/00* (2013.01); *F04C 29/0007* (2013.01); *F04C 2220/10* (2013.01); *F04C 2240/10* (2013.01)

(58) Field of Classification Search
CPC .. F04C 2220/10; F04C 2240/10; F01C 1/126; F01C 19/005
See application file for complete search history.

(56) References Cited

FOREIGN PATENT DOCUMENTS

| | | | | | |
|---|---|---|---|---|---|
| GB | 2528450 | A | | 1/2016 | |
| GB | 2528451 | A | * | 1/2016 | ..... F01C 19/005 |
| GB | 2528451 | A | | 1/2016 | |
| GB | 2558626 | A | | 7/2018 | |
| JP | 2003307192 | A | | 10/2003 | |
| WO | 2007063341 | A1 | | 6/2007 | |
| WO | WO-2008044064 | A3 | * | 6/2008 | ..... F01C 21/104 |
| WO | 2009044197 | A2 | | 4/2009 | |

OTHER PUBLICATIONS

PCT Notification of Transmittal of the International Search Report and the Written Opinion of the International Searching Authority, or the Declaration dated Dec. 17, 2020 and PCT International Search Report dated Dec. 17, 2020 for corresponding PCT application Serial No. PCT/GB2020/052512, 5 pages.

PCT Written Opinion of the International Searching Authority, or the Declaration dated Dec. 17, 2020 for corresponding PCT application Serial No. PCT/GB2020/052512, 6 pages.

PCT Notification of Transmittal of the International Preliminary Report on Patentability dated Feb. 8, 2022 for corresponding PCT application Serial No. PCT/GB2020/052512, 7 pages.

First Chinese Office Action dated Oct. 18, 2023 and Search Report dated Oct. 16, 2023 for corresponding Chinese Application No. CN202080089294.3, 7 pages.

* cited by examiner

MULTI-STAGE PUMP APPARATUS INCLUDING SEALING MEMBER

CROSS-REFERENCE TO RELATED APPLICATION

This application is a Section 371 National Stage Application of International Application No. PCT/GB2020/052512, filed Oct. 9, 2020, and published as WO 2021/079088 A1 on Apr. 29, 2021, the content of which is hereby incorporated by reference in its entirety and which claims priority of British Application No. 1915358.4, filed Oct. 23, 2019.

FIELD

The present disclosure relates to pump apparatus. Aspects and embodiments of the invention provide a stator component for a pump housing, a cover plate for a pump housing, a pump housing and a pump.

BACKGROUND

Certain vacuum systems, such as mass spectrometry systems, may comprise multiple vacuum chambers. The pressure is reduced in stages through consecutive chambers. Each chamber communicates with adjacent chambers via a restriction and requires individual pumping to provide the required vacuum. The pumping of these systems is conventionally performed using a plurality of pumps, one or more pumps for each chamber. There may be a high vacuum pump, such as a turbomolecular pump, for pumping the highest vacuum chamber, while lower vacuum chamber(s) are pumped by other lower vacuum pumps, such as a scroll or Roots pump. The turbo pump is a secondary pump and as such is itself backed by a pump such as a scroll pump.

A multi-stage vacuum pump 103 is schematically shown in FIG. 9. The vacuum pump 103 comprises seven stages 172. The stages of the vacuum pump 103 progressively decrease in size as the pressure within the vacuum pump 103 increases. The vacuum pump 103 comprises a fluid input inlet 113 connected to an inlet stage 112; and an exhaust 117 connected to an outlet stage 172. The fluid is input at the fluid input inlet 113 at a relatively low pressure and pumped through each of the stages in series and output at the exhaust 117 at atmospheric pressure. The fluid is pumped through each of the stages in sequence, as illustrated by the flow arrows shown in FIG. 9.

It would be desirable to provide a cost and space efficient pump that would be suitable for differentially pumping multiple chambers.

The discussion above is merely provided for general background information and is not intended to be used as an aid in determining the scope of the claimed subject matter. The claimed subject matter is not limited to implementations that solve any or all disadvantages noted in the background.

SUMMARY

Aspects and embodiments of the invention provide a stator component for a pump housing, a cover plate for a pump housing, a pump housing and a pump as claimed in the appended claims According to an aspect of the present invention there is provided a stator component for a pump housing, the stator component comprising:

a plurality of fluid inlet channels for conveying fluid to respective pumping chambers, each fluid inlet channel having an inlet port for conveying fluid into the pumping chamber; and a plurality of fluid transfer channels for conveying fluid to a respective one of the fluid inlet channels, each fluid transfer channel having an inlet for receiving pumped fluid;

characterised in that the stator component is adapted to receive at least one sealing member for at least substantially sealing the fluid transfer channel or the inlet port to inhibit the conveyance of pumped fluid into an associated one of the pumping chambers.

In use, the at least one sealing member may cooperate with the stator component to form a substantially fluid-tight seal. The sealing member thereby inhibits the conveyance of fluid into the pumping chamber. The conveyance of fluid through the pump is thereby modified. The stator component may be for a multi-stage pump, for example a multi-stage positive displacement pump. The pump may, for example, be a Roots, claw or screw pump. The stator component has particular application in a multi-stage vacuum pump.

The fluid transfer channel may be configured to receive pumped fluid from another pumping chamber. The fluid transfer channel inlet may be configured to receive fluid pumped from a fluid transfer channel formed in a separate stator component. By way of example, the pump housing may comprise first and second stator components.

The stator component may comprise a seat for receiving the sealing member. The seat may be configured to cooperate with the sealing member to form a substantially fluid-tight seal. The sealing member may form the substantially fluid-tight seal when seated in the seat. The seat may comprise a sealing surface for cooperating with the sealing member. The sealing surface may be substantially planar. Sealing means, such as a gasket or a sealant, may optionally be provided between the sealing member and the seat.

The seat may extend at least partway around the inlet port or the fluid transfer channel inlet. For example, the seat may comprise or consist of a ring-shaped sealing surface extending at least partway around the inlet port or the fluid transfer channel inlet.

The seat may comprise a recess. At least a portion of the sealing member may locate in the recess to form the substantially fluid-tight seal. The sealing surface may be formed on the recess.

The stator component may comprise a half-shell stator component. The stator component may comprise a first half-shell stator component for fastening to a second half-shell stator component. The first and second half-shell stator components may form the plurality of pumping chambers. The first half-shell stator component may be an upper component in the pump housing; and the second half-shell stator component may be a lower component in the pump housing. The first half-shell stator component may be mounted on top of the second half-shell stator component.

According to a further aspect of the present invention there is provided a stator assembly comprising a stator component as described herein and a sealing member. The sealing member and the stator component may cooperate with each other to inhibit the conveyance of fluid to the pumping chamber.

The sealing member may be removable, for example to enable the pump to be configured in a plurality of operating modes. Alternatively, the sealing member may be fastened in place.

The sealing member may at least substantially seal the fluid transfer channel to inhibit the conveyance of fluid to the fluid inlet channel. The sealing member may be disposed at or proximal to an inlet or an outlet of the fluid transfer channel. The sealing member may optionally be disposed at or proximal to the fluid transfer channel inlet. The sealing member may be disposed between the first and second half-shell stator components. The sealing member may comprise a sealing plate. The sealing plate may locate in a seat formed at the fluid transfer channel inlet or at the fluid transfer channel outlet. The seat may be recessed.

The stator assembly may comprise fastening means for fastening the sealing member in position. The fastening means may comprise one or mechanical fastener; or an adhesive fastener. The sealing member may be a restriction fit in the fluid transfer channel.

The sealing member may at least substantially seal the inlet port to inhibit the conveyance of fluid to the pumping chamber. The sealing member may comprise a sealing plate for sealing the inlet port.

The sealing member may comprise an insert for closing the fluid inlet channel. The insert may extend across the fluid inlet channel to form the seal.

The sealing member may comprise a fluid input inlet for admitting fluid to the pumping chamber from an external fluid source. The fluid input inlet may comprise an inlet port. The external fluid source may be distinct from the fluid transfer channel and the fluid inlet channel.

The stator assembly may comprise a cover plate fastened to the stator component. The cover plate may define a sidewall of the fluid inlet channels. For example, the fluid inlet channels formed in the stator component may be open channels which are closed by the cover plate. The sealing member may be provided on the cover plate. The sealing member may be mounted to the cover plate. Alternatively, the sealing member may be formed integrally with the cover plate.

In a variant, the cover plate and the sealing member may be separate from each other. The cover plate and the sealing member may cooperate with each other to form the seal. The cover plate may retain the sealing member in position.

According to a further aspect of the present invention there is provided a stator component for a pump housing, the stator component comprising:

a plurality of fluid outlet channels for conveying pumped fluid from respective pumping chambers, each fluid outlet channel having an outlet port for receiving pumped fluid from the pumping chamber; and a plurality of fluid transfer channels for conveying fluid from a respective one of the fluid outlet channels, each fluid transfer channel having an outlet for conveying pumped fluid;

characterised in that the stator component is adapted to receive a sealing member for inhibiting the conveyance of pumped fluid through the fluid transfer channel outlet.

According to a further aspect of the present invention there is provided a pump comprising a pump housing having a stator component as described herein.

According to a still further aspect of the present invention there is provided a method of converting a stator component to receive at least one sealing member. The stator component is suitable for a pump housing and may comprise a plurality of fluid inlet channels for conveying fluid to respective pumping chambers. The stator component may comprise a plurality of fluid transfer channels for conveying fluid to a respective one of the fluid inlet channels. The method may comprise forming a seat in the stator component for receiving at least one sealing member to at least substantially seal the fluid transfer channel to inhibit the conveyance of pumped fluid into an associated one of the pumping chambers. The seat may be formed in the stator component by performing a machining operation, such as drilling and or milling.

The seat may comprise or consist of a ring-shaped sealing surface extending at least partway around an inlet port of one of the fluid inlet channels. Alternatively, or in addition, the seat may comprise or consist of a ring-shaped sealing surface extending at least partway around one of the fluid transfer channel inlets. The forming of the seat may comprise forming a recess in the stator component.

The references to the first one of the outlet channels and the second one of the outlet channels are not intended to infer a particular sequence or proximity of the outlet channels or the associated pumping chambers in relation to each other. The outlet channels may be adjacent to each other. For example, the first one of the outlet channels may be associated with a first pumping chamber and the second one of the outlet channels may be associated with a second pumping chamber. In this arrangement, the diversion channel may be configured to bypass the second pumping chamber. Alternatively, the outlet channels may be spaced apart (separated) from each other. For example, one or more intermediate outlet channels may be disposed between the first one of the outlet channels and the second one of the outlet channels. In this arrangement, the diversion channel may be configured to bypass the or each of the intermediate pumping chambers.

According to a further aspect of the present invention there is provided a cover plate for fastening to a stator component of a pump housing. The cover plate may comprise a fluid input inlet for admitting fluid to a pumping chamber from an external fluid source.

According to a further aspect of the present invention there is provided a method of converting a cover plate for use in a pump housing in accordance with the present invention. The conversion may comprise forming a fluid input inlet in the cover plate for admitting fluid to a pumping chamber from an external fluid source. The fluid input inlet may forma second inlet for the pump housing. The fluid input inlet may be configured to introduce fluid into a second pumping chamber formed in the pump housing.

According to a further aspect of the present invention there is provided a pump comprising: a pump housing comprising a plurality of pumping chambers, a first fluid input inlet for conveying fluid into a first one of the pumping chambers; and a second fluid input inlet for conveying fluid into a second one of the pumping chambers. The pump may comprise a first control valve for controlling the supply of fluid to the first fluid input inlet; and a second control valve for controlling the supply of fluid to the second fluid input inlet.

The first and second control valves may be controllable independently of each other. The pump may be configurable to operate with the first control valve open and the second control valve closed. Conversely, the pump may be configurable to operate with the second control valve open and the first control valve closed.

The references to the first one of the pumping chambers and the second one of the pumping chambers are not intended to infer a particular sequence or proximity of the pumping chambers in relation to each other. The pumping chambers may be adjacent to each other or may be spaced apart from each other. For example, one or more intermediate pumping chambers may be disposed between the first one of the pumping chambers and the second one of the pumping chambers.

A pump control unit may be provided for controlling operation of the first and second control valves. The pump control unit may comprise a controller, for example comprising at least one electronic processor and a memory device.

The pump may be a vacuum pump. The pump may be a multi-stage positive displacement vacuum pump.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

One or more embodiments of the invention will now be described, by way of example only, with reference to the accompanying drawings, in which.

DETAILED DESCRIPTION

Figure 1:
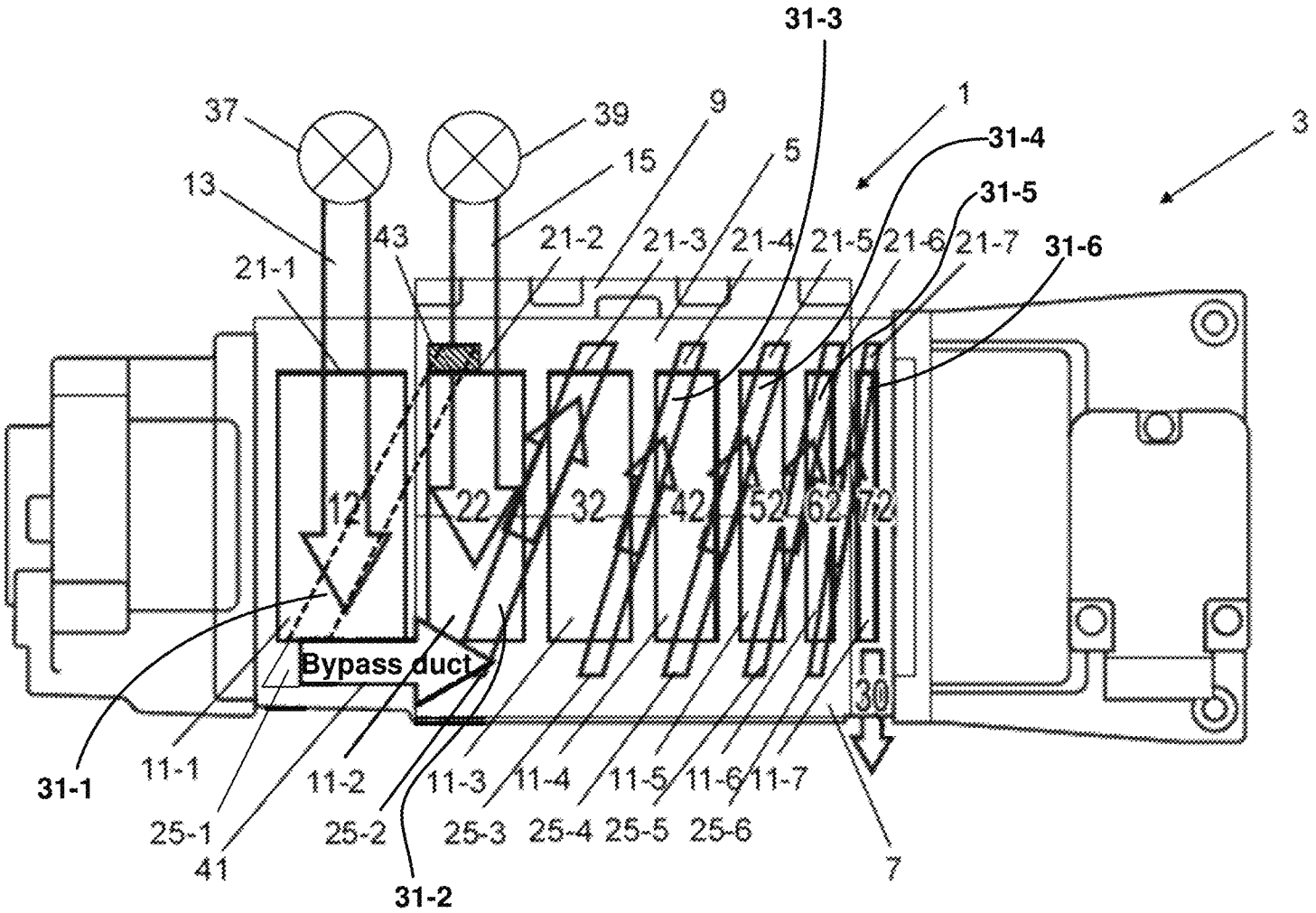
FIG. 1 shows a schematic representation of a multi-stage vacuum pump in accordance with an embodiment of the present invention.

A pump housing 1 in accordance with an embodiment of the present invention is described herein with reference to the accompanying figures. A pump 3 comprising the pump housing 1 is shown in FIG. 1. The pump 3 may, for example, be a Roots pump. The pump 3 is a multi-stage positive displacement pump. In the present embodiment, the pump 3 is a multi-stage positive displacement vacuum pump.

Figure 2:
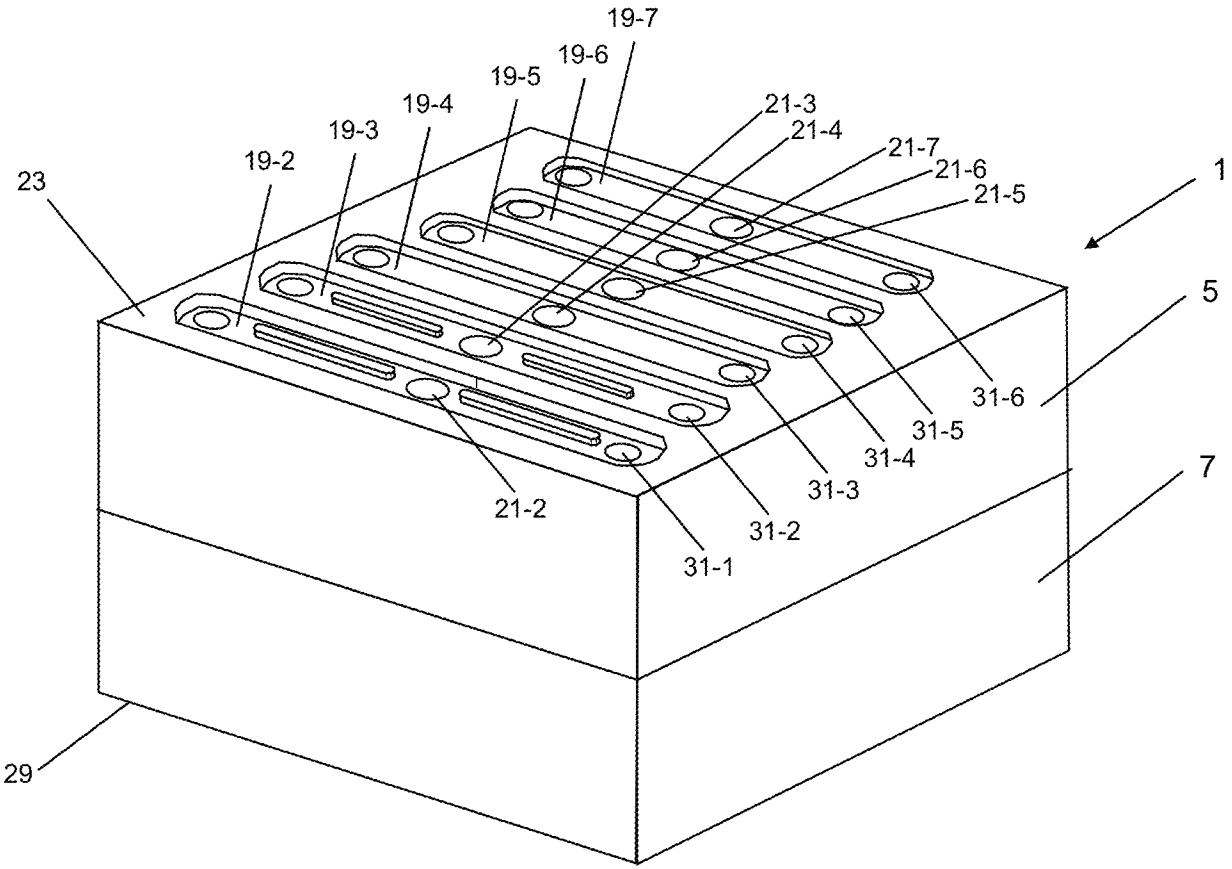
FIG. 2 shows a perspective view of a stator assembly comprising first and second stator components of the multi-stage vacuum pump shown in FIG. 1.

The pump housing 1 comprises a first stator component 5, a second stator component 7 and a cover plate 9. As shown in FIG. 2, the first stator component 5 and the second stator component 7 form a stator assembly of the pump housing 1. In the present embodiment, the first and second stator components 5, 7 are respective first and second half-shell stator components. The first stator component 5 is mounted on top of the second stator component 7. As shown in FIG. 1, the cover plate 9 is mounted on an upper surface of the first stator component 5. The first and second stator components 5, 7 and the cover plate 9 are assembled using mechanical fasteners, such as bolts. The first and second stator components 5, 7 are machined, cast or otherwise formed.

The first and second stator components 5, 7 define a plurality of pumping chambers 11-*n* in the pump housing 1. The pumping chambers 11-*n* each form a stage of the pump 3. The pump 3 in the present embodiment has seven (7) pumping chambers 11-1, 11-2, 11-3, . . . 11-7 corresponding to seven (7) stages. In particular, the pump 3 comprises a first stage 12, a second stage 22, a third stage 32, a fourth stage 42, a fifth stage 52, a sixth stage 62 and a seventh stage 72. The stages of the pump 3 are referenced herein in relation to their position within the pump housing 1. The sizes of the pumping chambers 11-n in the pump 3 progressively decrease; the first pumping chamber 11-1 having the largest volume and the seventh pumping chamber 11-7 having the smallest volume. The pump housing 1 comprises a first fluid input inlet 13 connected to the first stage 12; a second fluid input inlet 15 connected to the second stage 22; and an exhaust 30 connected to the seventh stage 72. First and second external fluid sources are connected to the first and second fluid input inlets 13, 15 respectively. In use, the first and second external fluid sources supply first and second fluid flows. As described herein, the fluid pumped through the pump 3 does not necessarily pass through all of the stages 12, 22, 32, 42, 52, 62, 72 of the pump 3. Furthermore, the fluid is not necessarily pumped through each of the stages 12, 22, 32, 42, 52, 62, 72 in sequence. In a variant, the second fluid input inlet 15 may be connected to one of the other intermediate stages 32, 42, 52, 62.

The pump 3 in the present embodiment effectively utilises the seven stages as two six-stage pumps. The first six-stage pump, pumps fluid from the first fluid input inlet 13 via the first stage 12 through the third stage 32, the fourth stage 42, the fifth stage 52, the sixth stage 62 and the seventh stage 72 to exhaust 30. The second six-stage pump introduces fluid through the second fluid input inlet 15 via the second stage 22, through the third stage 32, the fourth stage 42, the fifth stage 52, the sixth stage 62 and the seventh stage 72 to exhaust 30. Thus, in the present embodiment the third stage 32, the fourth stage 42, the fifth stage 52, the sixth stage 62 and the seventh stage 72 are shared by fluid input from each of the first and second fluid input inlets 13, 15. The first stage 12 pumps fluid exclusively input from the first fluid input inlet 13; and the second stage 22 pumps fluid exclusively input from the second fluid input inlet 15.

The first stator component 5 comprises a plurality of fluid inlet channels 19-*n*, the fluid inlet channels 19-*n* each being associated with one of the pumping chambers 11-*n*. The fluid inlet channels 19-*n* each comprise an inlet port 21-*n* for conveying fluid into the associated pumping chambers 11-*n*. As shown in FIG. 2, the inlet channels 19-*n* are open on the top external surface 23 (as illustrated) of the first stator component 5. The second stator component 7 comprises a plurality of fluid outlet channels 25-*n* through which pumped fluid is exhausted. The fluid outlet channels 25-*n* each have an outlet port (not shown) for exhausting fluid from an associated one of the pumping chambers 11-*n*. The outlet ports are open on the bottom external surface 29 of the second stator component 7.

The first and second stator components 5, 7 define fluid transfer channels 31-*n* for conveying fluid between the pumping chambers 11-*n*. In particular, the fluid transfer channels 31-*n* are configured to convey fluid from the fluid outlet channels 25-*n* to respective fluid inlet channels 19-*n*. A first fluid transfer channel 31-1 is arranged to convey fluid from the first outlet channel 25-1 (shown in dashed lines in FIG. 1) of the first pumping chamber 11-1 to the second inlet channel 19-2 of the second pumping chamber 11-2. A second fluid transfer channel 31-2 is arranged to convey fluid from the second outlet channel 25-2 of the second pumping chamber 11-2 to the third inlet channel 19-3 of the third pumping chamber 11-3. This pattern is repeated for each of the pumping chambers 11-*n* such that, in use, fluid is pumped from the first pumping chamber 11-1 to the seventh pumping chamber 11-7 through each of the intermediate pumping chambers 11-*n* in sequence.

Each fluid transfer channel 31-*n* is formed in both the first stator component 5 and the second stator component 7. A first (upper) section of the fluid transfer channel 31-*n* is formed in the first stator component 5 to convey fluid to the inlet channel 19-*n*. A second (lower) section of the fluid transfer channel 31-*n* is formed in the second stator component 7 to convey fluid from the outlet channel 25-*n*. The first section of the fluid transfer channel 31-*n* has a transfer channel inlet 33-*n* for receiving fluid from a transfer channel outlet formed in the second section of the fluid transfer channel 33-*n*. In the present embodiment, the inlet fluid transfer channels 31-*n* extend substantially orthogonal to the top and bottom external surfaces 23, 29 to facilitate manufacture and cleaning.

Figure 3:
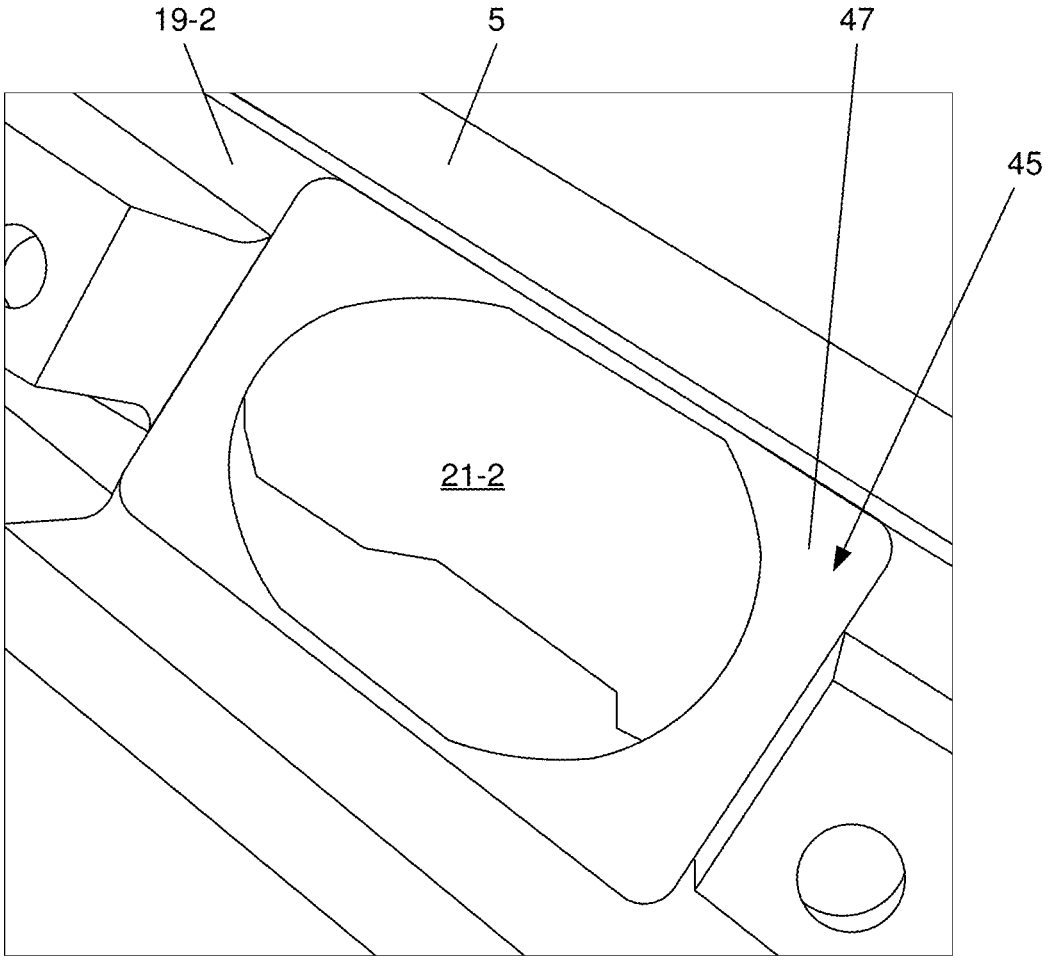
FIG. 3 shows an enlarged view of the first stator component and a recess for receiving a sealing member to seal the inlet port.

The inlet channels 19-*n* are shaped to convey fluid from the transfer channels 31-*n* into respective pumping chambers 11-*n*. The fluid is introduced into the pumping chambers 11-*n* from the inlet channels 19-*n* via the inlet ports 21-*n*. In the present embodiment, each inlet channel 19-*n* extends in a transverse direction across a substantial part of the width of the pump housing 1. The inlet channels 19-*n* are in the form of one or more slots (or grooves) formed in the top external surface 23 of the first stator component 5. As shown in FIG. 2, the first and second inlet channels 19-1, 19-2 in the present embodiment each comprise a pair of slots separated by an intermediate wall. The cover plate 9 is fastened to the first stator component 5 to close the open top portion of the slots. The second inlet port 21-2 for conveying fluid into the second pumping chamber 11-2 is shown in FIG. 3.

The outlet channels 25-*n* are shaped to convey pumped fluid from the outlet ports to respective transfer channels 31-*n*. The pumped fluid is exhausted from the pumping chambers 11-*n* through the outlet ports and into the outlet channels 25-*n*. The outlet channels 25-*n* may be inclined at an acute angle to a longitudinal axis of the pump housing 1 for conveying pumped fluid to the transfer channel 31-*n* associated with the next pumping chamber 11-*n*. Alternatively, or in addition, the transfer channels 31-*n* may be inclined at an acute angle to the longitudinal axis of the pump housing 1.

As outlined above, first and second fluid flows are connected to the first and second fluid input inlets 13, 15. The first fluid input inlet 13 is configured to admit fluid into the first pumping chamber 11-1 from a first external fluid source; and the second fluid input inlet 15 is configured to admit fluid into the second pumping chamber 11-2 from a second external fluid source. The pump 3 in the present embodiment comprises first and second control valves 37, 39 for selectively controlling the supply of fluid to the first and second fluid input inlets 13, 15. The first and second control valves 37, 39 can be controlled independently of each other. A controller may be provided for controlling the first and second control valves 37, 39.

A diversion channel (or bypass duct) 41 is provided for diverting pumped fluid from the first outlet channel 25-1 to the second outlet channel 25-2. The diversion channel 41 bypasses the first transfer channel 31-1, effectively bypassing the second pumping chamber 11-2. The diversion channel 41 in the present embodiment is formed in the second stator component 7. The diversion channel 41 may, for example, comprise an aperture or a conduit for establishing a fluid pathway between the first and second outlet channels 25-1, 25-2. The fluid is diverted from the first outlet channel 25-1 to the second outlet channel 25-2 and admitted into the second transfer channel 31-2. In a variant, the diversion channel 41 may be configured to convey fluid from the first pumping chamber 11-1 to one of the other pumping chambers 11-*n*. For example, the diversion channel 41 could be configured to connect the first outlet channel 25-1 with the third outlet channel 25-3.

The pump housing 1 comprises a sealing member 43 (shown in FIG. 1) for inhibiting the conveyance of fluid from the first pumping chamber 11-1 to the second pumping chamber 11-2 via the first transfer channel 31-1. In the present embodiment, the sealing member 43 is configured at least substantially to seal the second inlet port 21-2 through which fluid is conveyed into the second pumping chamber 11-2. The sealing member 43 is in the form of an insert which extends around the perimeter of the second inlet port 21-2. As shown in FIG. 3, the first stator component 5 comprises a seat 45 for cooperating with the sealing member 43 to form the seal. The seat 45 in the present embodiment comprises a recess for receiving a portion of the sealing member 43. The seat 45 defines a sealing surface 47 for cooperating with the sealing member 43. The sealing member 43 thereby forms a seal operative to inhibit the conveyance of fluid through the second inlet port 21-2. In the present embodiment, the sealing member 43 is formed integrally with the cover plate 9. The sealing member 43 is fastened in position when the pump housing 1 is assembled. By forming the sealing member 43 and the cover plate 9 integrally, the sealing member 43 cannot be omitted when the pump housing 1 is assembled. In a variant, the sealing member 43 may be a separate component, for example mounted to the cover plate 9. The pump housing 1 may comprise sealing means, such as a sealant or a gasket, to enhance the seal established by the sealing member 43.

Figure 4:
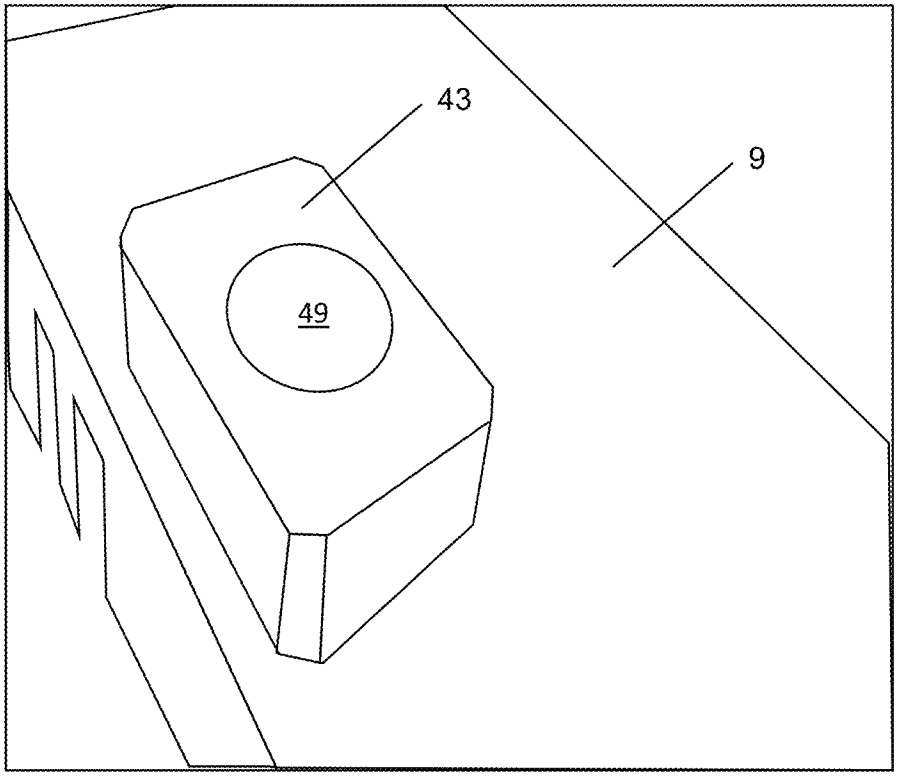
FIG. 4 shows a perspective view of an underside of a cover plate incorporating a sealing member to locate in the seat shown in FIG. 3.
Figure 5:
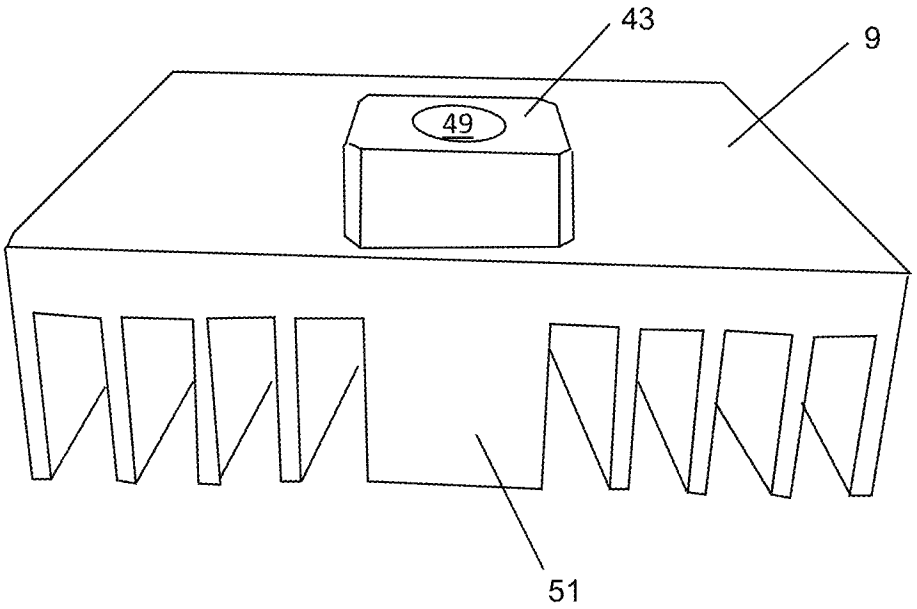
FIG. 5 shows an end view of the cover plate shown in FIG. 4.

The sealing member 43 in the present embodiment also forms the second fluid input inlet 15 to admit fluid into the second pumping chamber 11-2 from the second external fluid source. As shown in FIGS. 4 and 5, the second fluid input inlet 15 comprises an inlet aperture 49 extending through the cover plate 9. The cover plate 9 comprises a connector 51 for connecting the second external fluid source. In the present embodiment, the connector 51 is formed integrally with the cover plate 9. The inlet aperture 49 extends through the connector 51. The connector 51 comprises one or more fasteners (not shown) for connecting the second external fluid source.

The pump housing 1 is assembled by mounting the first stator component 5 on the second stator component 7 to form the pumping chambers 11-*n*. The cover plate 9 is fastened to the first stator component 5. The sealing member 43 locates in the seat 45 and seals the second inlet port 21-2. The sealing member 43 forms the second fluid input inlet 15 for receiving fluid from a second external source.

The operation of the pump 3 will now be described. A first fluid flow is supplied to the first pumping chamber 11-1 via the first fluid input inlet 13. A second fluid flow is supplied to the second pumping chamber 11-1 via the second fluid input inlet 15. The first and second control valves 37, 39 are actuated to control the supply of the first and second fluids. The first and second control valves 37, 39 can be opened simultaneously such that the first and second fluid flows are provided simultaneous to the pump 3. In the present embodiment, the first and second fluids can be mixed within the third pumping chamber 11-3. In a variant, one of the first and second control valves 37, 39 can be opened and the other one of the first and second control valves 37, 39 can be closed. This enables the pump 3 to be configured selectively to pump one of the first and second fluids. The pump 3 is configured to differentially pump multiple chambers. The first inlet 13 configured to connect to a lower vacuum chamber and the second inlet 15 is configured to act as a backing pump for a vacuum pump pumping a higher vacuum chamber. The pump 3 is configured to pump at a higher gas flow rate through the first inlet 13 than through the second inlet 15. The pump 3 is configured to pump a gas flow rate through the first inlet 13 that may be greater than ten (10) times higher than the gas flow rate through the second inlet 15.

Figure 6:
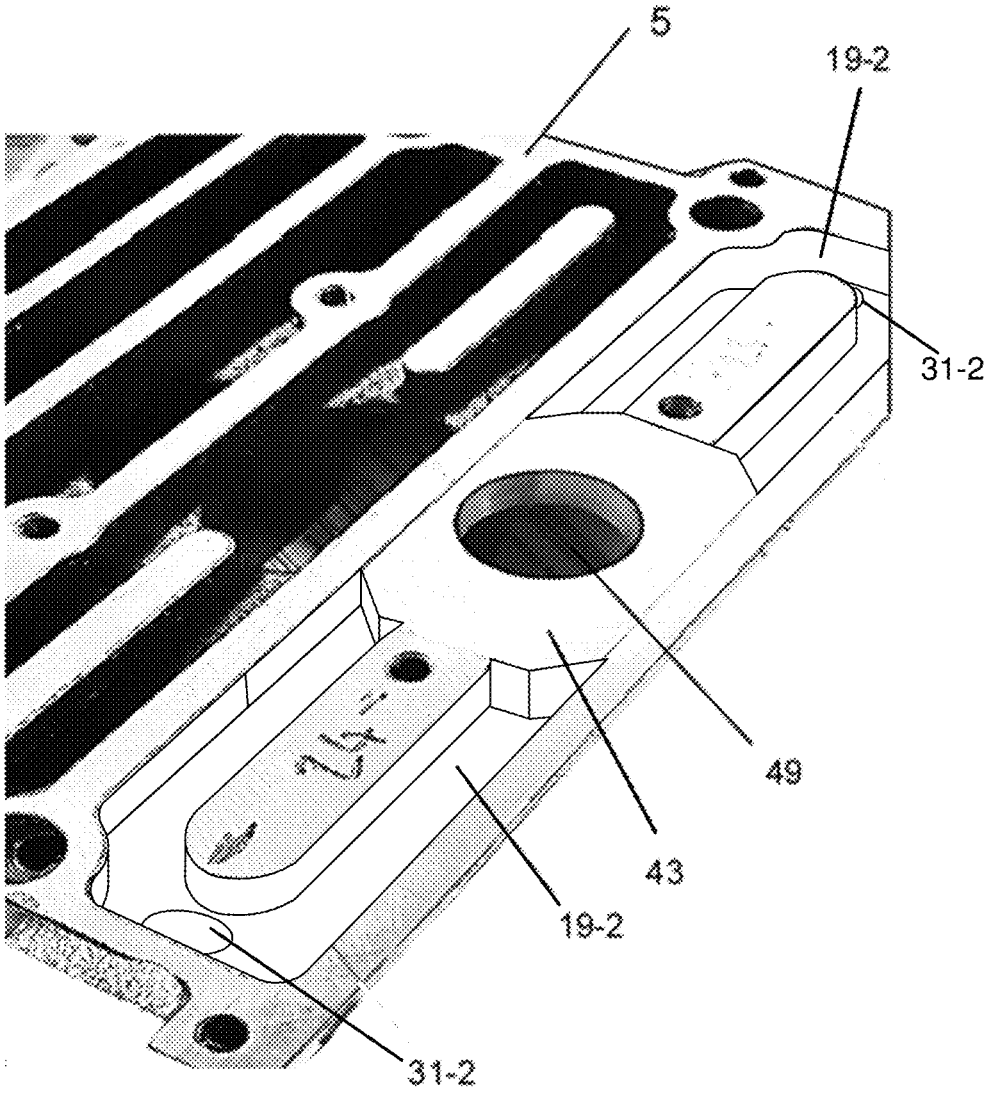
FIG. 6 shows a variant of the first stator component incorporating a separate sealing member to seal the inlet port.

In the above embodiment the sealing member 43 is disposed on the cover plate 9. In a variant, the sealing member 43 may be a separate component which locates in the second fluid inlet channel 19-2 to seal the second inlet port 21-2. This variant is illustrated in FIG. 6. The cover plate 9 is mounted to the first stator component 5, thereby retaining the sealing member 43 in position.

Figure 8:
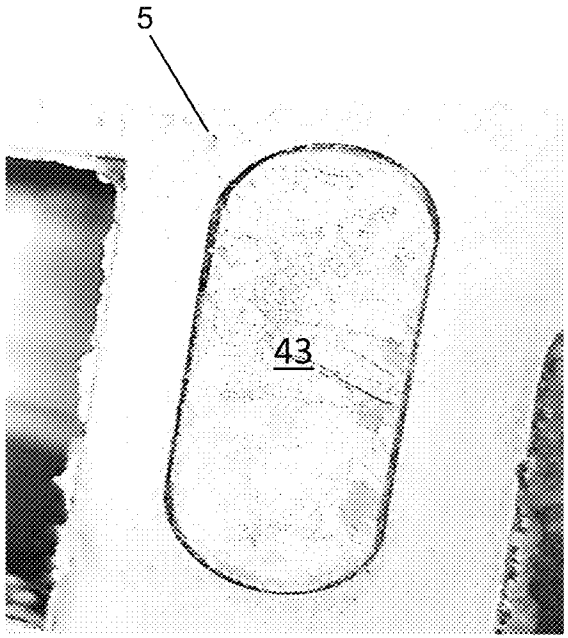
FIGS. 7 and 8 shows a further variant of the first stator component incorporating a sealing plate to seal the fluid transfer channel.
Figure 7:
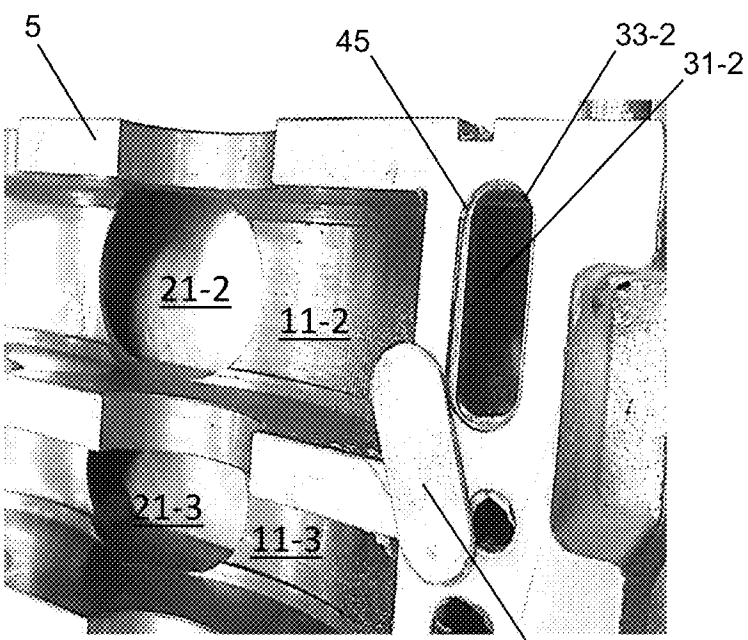
Figure 9:
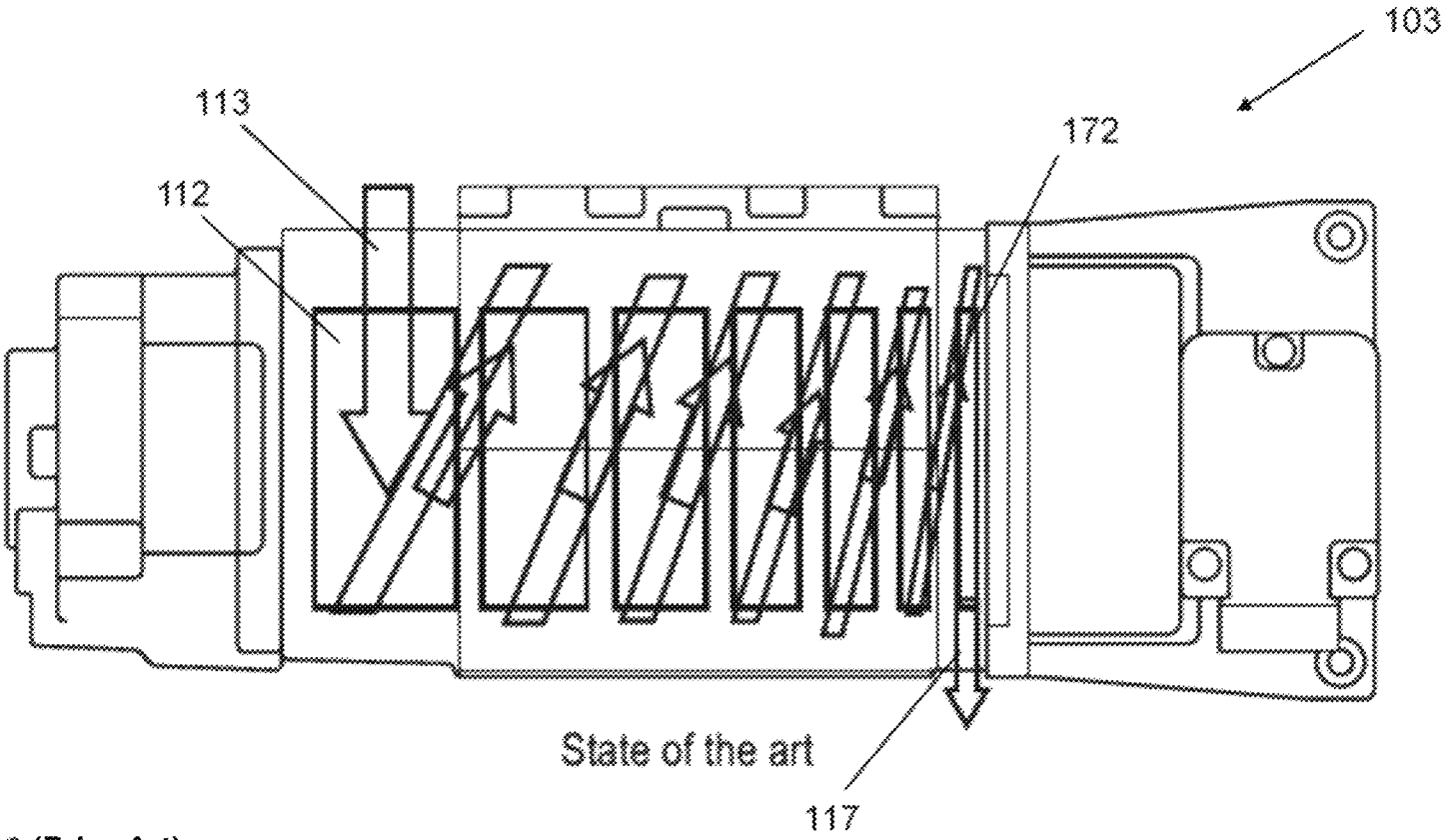
FIG. 9 (Prior Art)
FIG. 9 shows a known multi-stage vacuum pump.

A further embodiment of the pump housing 1 will now be described with reference to FIGS. 7 and 8. Like reference numerals are used for like components. The description herein will focus on the differences over the previous embodiment.

The pump housing 1 described with reference to FIGS. 1 to 6, comprises a sealing member 43 for sealing the second inlet port 21-2. In the present embodiment, the sealing member 43 is configured to seal the first transfer channel 31-1. As shown in FIG. 7, the sealing member 43 comprises a sealing plate which is mounted in the transfer channel inlet 33-1. The sealing member 43 is thereby disposed at the interface between the first and second stator components 5, 7. The first stator component 5 comprises a seat 45 for receiving the sealing plate. The seat 45 comprises a recess formed in a lower face of the first stator component 5. The sealing member 43 is fixed in position when the first stator component 5 is fastened to the second stator component 7.

It will be understood that this embodiment may be modified by forming the seat 45 in the second stator component 5. For example, the seat 45 may be formed in the upper face of the second stator component 7.

A separate connector 51 may be provided for connecting the second external fluid source to the second pumping chamber 11-2. The connector 51 may, for example, be open to the second inlet channel 19-2.

As outlined above, the first and second stator components 5, 7 may be formed using appropriate techniques, such as machining and/or casting. According to a further aspect of the present invention there is provided a method of converting a first stator component 5 and/or a second stator component 7 of a prior art pump housing 1 to implement at least some of the features described herein.

An embodiment of the present invention may relate to a method of converting a first stator component 5 comprising a plurality of fluid inlet channels **19-*n* for conveying fluid to respective pumping chambers 11-*n*, and a plurality of fluid transfer channels 31-*n* for conveying fluid to a respective one of the fluid inlet channels 19-*n*. The conversion process may comprise forming a seat 45 in the stator component 5 for receiving at least one sealing member 43 to inhibit the conveyance of fluid into an associated one of the pumping chambers 11-*n*. As described herein, the seat 45 may comprise or consist of a ring-shaped sealing surface 47 extending at least partway around an inlet port 21-*n* of one of the fluid inlet channels 19-*n*. Alternatively, or in addition, the seat 45 may comprise or consist of a ring-shaped sealing surface 47 extending at least partway around one of the fluid transfer channel inlets 33-*n*. The seat 45 may be formed by forming a recess in the stator component 5, for example by milling a surface of the first stator component 5. The seat 45** may comprise or consist of a substantially planar surface.

An embodiment of the present invention may relate to a method of converting a second stator component 7 comprising a plurality of fluid outlet channels **25-*n* for conveying fluid from pumping chambers 11-*n*, and a plurality of fluid transfer channels 31-*n* for conveying pumped fluid from the fluid outlet channels 25-*n*. The method may comprise forming a diversion channel 41 in the stator component 5 for diverting pumped fluid from a first one of the outlet channels 25-*n* to a second one of the outlet channels 25-*n*. The diversion channel 41 may be formed using one or more machining operations, such as drilling and/or milling. As described herein, the outlet channels 25-*n* are associated with respective pumping chambers 11-*n* in the assembled pump housing. The first one of the outlet channels 25-*n* may be associated with a first pumping chamber 11-1 and the second one of the outlet channels 25-*n* may be associated with a second pumping chamber 11-2. In this arrangement, the diversion channel 41 may be configured to bypass the second pumping chamber 11-2. Alternatively, the outlet channels 25-*n* may be spaced apart from each other. For example, one or more intermediate outlet channels 25-*n* may be disposed between the first one of the outlet channels 25-*n* and the second one of the outlet channels 25-*n*. In this arrangement, the diversion channel 41 may be configured to bypass the or each intermediate pumping chamber 11-*n***.

It will be appreciated that various changes and modifications can be made to the present invention without departing from the scope of the present application.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A stator component for a pump housing, the stator component comprising:

a plurality of fluid inlet channels for conveying fluid to respective pumping chambers, each fluid inlet channel having an inlet port for conveying fluid into the pumping chamber; and a plurality of fluid transfer channels for conveying fluid to a respective one of the fluid inlet channels, each fluid transfer channel having an inlet for receiving pumped fluid;

characterised in that the stator component is adapted to receive a sealing member for at least substantially sealing a fluid transfer channel from one of the pumping chambers to a subsequent pumping chamber of the pumping chambers or the inlet port to the subsequent pumping chamber to inhibit the conveyance of pumped fluid from the one of the pumping chambers into the subsequent pumping chamber while allowing other fluid to enter the subsequent pumping chamber.

2. The stator component as claimed in claim 1 comprising a seat for receiving the sealing member to form a substantially fluid-tight seal.

3. The stator component as claimed in claim 2, wherein the seat comprises or consists of a ring-shaped sealing surface extending at least partway around the inlet port or the fluid transfer channel inlet.

4. The stator component as claimed in claim 2, wherein the seat comprises a recess.

5. The stator component as claimed in claim 1, wherein the stator component comprises a first half-shell stator component for fastening to a second half-shell stator component.

6. A stator assembly for a pump housing, the stator assembly comprising the stator component as claimed in claim 1 and the sealing member.

7. The stator assembly as claimed in claim 6, wherein the sealing member at least substantially seals the fluid transfer channel from the one of the pumping chambers to the subsequent pumping chamber to inhibit the conveyance of pumped fluid to the fluid inlet channel of the subsequent pumping chamber.

8. The stator assembly as claimed in claim 6, wherein the sealing member at least substantially seals the inlet port to inhibit the conveyance of pumped fluid from the one of the pumping chambers to the subsequent pumping chamber.

9. The stator assembly as claimed in claim 8, wherein the sealing member comprises a fluid input inlet for admitting fluid to the subsequent pumping chamber from an external fluid source.

10. The stator assembly as claimed in claim 6 comprising a cover plate fastened to the stator component, wherein the sealing member is disposed on the cover plate.

11. The stator assembly as claimed in claim 10, wherein the sealing member is formed integrally with the cover plate.

12. A pump comprising a pump housing having a stator component as claimed in claim 1.

13. The pump as claimed in claim 12, wherein the pump is a multi- stage positive displacement vacuum pump.

14. A method of converting a stator component to receive at least one sealing member, the stator component being for a pump housing and comprising a plurality of fluid inlet channels for conveying fluid to respective pumping chambers, and a plurality of fluid transfer channels each for conveying fluid to a respective one of the fluid inlet channels from a respective outlet channel of a respective pumping chamber;

characterised in that the method comprises forming a seat in the stator component for receiving a sealing member to at least substantially seal one fluid transfer channel of the plurality of fluid transfer channels to inhibit the conveyance of pumped fluid into an associated one of the pumping chambers from an associated preceding pumping chamber of the pumping chambers while permitting other fluid to enter the associated one of the pumping chambers.

15. The method as claimed in claim 14, wherein the seat comprises extending at least partway around an inlet of the one fluid transfer channel.

16. A stator assembly for a pump housing, the stator assembly comprising:

a stator component comprising:

a plurality of fluid inlet channels for conveying fluid to respective pumping chambers, each fluid inlet channel having an inlet port for conveying fluid into the pumping chamber; and a plurality of fluid transfer channels for conveying fluid to a respective one of the fluid inlet channels, each fluid transfer channel having an inlet for receiving pumped fluid;

characterised in that the stator component is adapted to receive a sealing member for at least substantially sealing a fluid transfer channel from one of the pumping chambers to a subsequent pumping chamber of the pumping chambers or the inlet port to the subsequent pumping chamber to inhibit the conveyance of pumped fluid from the one of the pumping chambers into the subsequent pumping chamber; and a cover plate fastened to the stator component, wherein the sealing member is formed integrally with the cover plate.

* * * * *